US005097615A

United States Patent [19]

Kearns

[11] Patent Number: 5,097,615

[45] Date of Patent: Mar. 24, 1992

[54] MUZZLE LOADING DEVICE FOR MUZZLE LOADING FIREARMS

[76] Inventor: Robert M. Kearns, 2801 N. 32nd St., Boise, Id. 83703

[21] Appl. No.: 745,398

[22] Filed: Aug. 15, 1991

[51] Int. Cl.[5] ..... F41C 27/00

[52] U.S. Cl. ..... 42/90

[58] Field of Search ..... 42/90

[56] References Cited

U.S. PATENT DOCUMENTS

| | | | |
|---|---|---|---|
| 163,404 | 5/1875 | Phillips | 42/90 |
| 3,747,252 | 7/1973 | Walker | 42/90 |
| 4,112,606 | 9/1978 | Griffin | 42/90 |
| 4,123,868 | 11/1978 | Wilson | 42/90 |
| 4,152,858 | 5/1979 | Dobbs | 42/90 |
| 4,373,285 | 2/1983 | Grout et al. | 42/90 |
| 4,536,983 | 8/1985 | Fry | 42/90 |
| 4,974,357 | 12/1990 | Jones et al. | 42/90 |

*Primary Examiner*—Charles T. Jordan

*Attorney, Agent, or Firm*—Paul F. Horton

[57] ABSTRACT

A device for loading black powder, a projectile, and optional components into the muzzle of a muzzle loading firearm. The device includes an elongated tubular cartridge for holding the components to be loaded; a cartridge receiving housing for placement of the cartridge relative to the muzzle; and a plunger for insertion of the components into the muzzle. The cartridge has a central bore, substantially equal in diameter to the bore of the firearm, and preferably is transparent for viewing of the components therein. A crimp or frangible membrane serves to close one end of the cartridge and the projectile closes the opposing end. The cartridge housing includes a slotted portion for receiving and holding the cartridge and is provided with end apertures, aligned with the base of the cartridge for reciprocally receiving the plunger. The housing preferably includes a jacket for fitting over the end of the muzzle for perfecting alignment of the muzzle and cartridge bores.

11 Claims, 1 Drawing Sheet

MUZZLE LOADING DEVICE FOR MUZZLE LOADING FIREARMS

BACKGROUND OF THE INVENTION

1. Field of the Invention

This invention relates, in general, to muzzle loading firearms and, more particularly, to devices for convenient and rapid loading of black powder or equivalent propellant, projectiles, wads, patches, or other components into the muzzle of muzzle loaded firearms.

2. Description of the Prior Art

Several devices have been invented for loading black powder, patches, projectiles and other components into the muzzle of a muzzle loaded type firearm. U.S. Pat. No. 3,747,252, issued to B. A. Walker, discloses a tool for aligning and loading a musket ball. Walker utilizes a plunger to eject the ball from a sleeve into the muzzle. U.S. Pat. No. 4,123,868, issued to H. R. Wilson, shows a cartridge for containing a pre-measured charge and a projectile. The powder is poured into the barrel and the projectile is then forced from the cartridge into the muzzle by a ramrod. U.S. Pat. No. 4,974,357, issued to L. D. Jones, discloses a speed loading device including a hollow tube with removable cap on one end for holding the charge and a removably secured guide member on the opposing end. The guide member receives a plunger. The cap is removed and the powder poured into the muzzle. The tube is then coaxially aligned with the muzzle and the plunger used to insert the patch and ball into the barrel. No devices are known, other than the present invention, which include cartridges receivable with a cartridge housing for holding the cartridge in coaxial alignment with the bore of a muzzle for insertion, in one maneuver, of the powder charge, patch, projectile, or other desired components into the muzzle of a firearm.

SUMMARY OF THE INVENTION

To overcome the disadvantages of the prior art, including the necessity of removing caps and pre-pouring of the powder charge; of refilling tools before each use; and the burden of carrying ungainly devices with ramrods in the extended position; the present invention includes a cartridge housing for convenient loading and unloading of cartridges and for precise alignment of cartridges with the muzzle of a firearm; a plunger operable to load the full contents of a cartridge into a muzzle with one stroke; and a cartridge carrying a complete charge, projectile, and perhaps other components, as desired, and having charge retention means automatically displaced by the plunger.

Additional objects and advantages will become apparent and a more thorough and comprehensive understanding may be had from the following description taken in conjunction with the accompanying drawings forming a part of this specification.

DETAILED DESCRIPTION OF THE INVENTION

Figure 1:
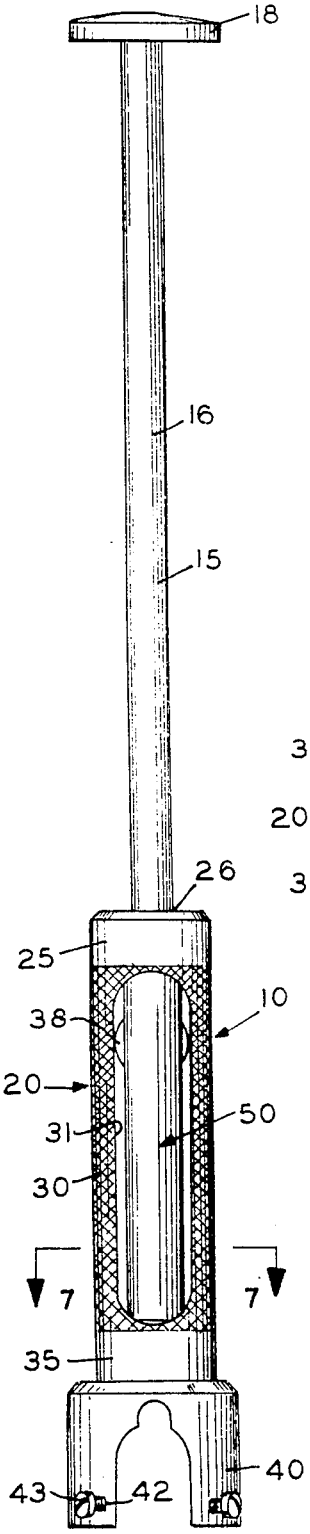
FIG. 1 is a side view of the muzzle loading device of the present invention, showing a full cartridge, in place, with the plunger in a retracted position.
Figure 2:
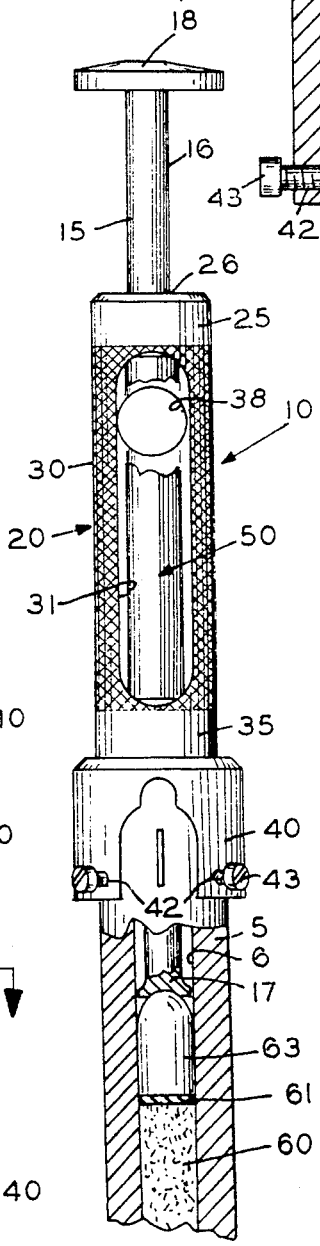
FIG. 2 is a side view of the device shown in FIG. 1 with the plunger depressed and the cartridge emptied.

Referring now to the drawings, and, more particularly, to FIGS. 1 and 2, an embodiment to be preferred of a muzzle loading device 10, made according to the present invention, is disclosed. Device 10 includes, generally, a cartridge housing 20; a cartridge 50, receivable within the housing; and a plunger 15, reciprocally movable within the housing for loading the contents of the cartridge into the bore of a muzzle loading type firearm.

Cartridge housing 20 may be constructed of any suitable material and is preferably integrally constructed of rigid thermoplastic or of machined aluminum. The housing is elongated, having a first end portion 25; a second end portion 35; and a mid portion 30.

Figure 3:
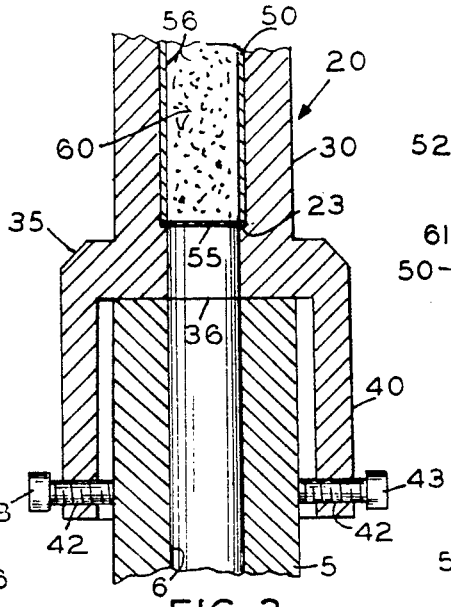
FIG. 3 is a partial view in cross section, showing the muzzle jacket surrounding the muzzle of a firearm for coaxial alignment of the bores of the muzzle and cartridge.

Mid portion 30 of the housing defines an elongated slot 31 for receiving cartridge 50. Each of the end portions are provided with an aperture, 26 and 36, respectively, coaxially aligned with the bore defined by slot 31 and with each other, for reciprocally receiving rod 16 of plunger 15. As shown to advantage in FIG. 3, cartridge housing 20 includes an annular shoulder 23, either molded or in the form of a sleeve contained within second end portion 35, for restraining longitudinal movement of the cartridge upon depression of plunger 15. Aperture 36 of the second end portion of the housing is equal in diameter to the bore 56 of cartridge 50 and to the bore 6 of muzzle 5 of the firearm. For convenient removal of cartridge 50, after the charge has been loaded, mid portion 30 of the housing, on the side opposing slot 31, is provided with a lateral, finger-size, aperture 38, extending through the side wall of the housing for pushing the cartridge from the slot.

While end portion 35 of the cartridge housing may be manually held directly over the muzzle for loading, or while the end portion may be chamfered, not shown, for proper alignment, it is much preferred and is an important aspect of the present invention, that second end portion 35 be provided with muzzle receiving means for precise and firm alignment of the bore 6 of muzzle 5; aperture 36; and bore 56 of the cartridge. For this purpose, a tubular jacket 40 is provided. Jacket 40 is preferably integral with housing 20 and includes an inside diameter slightly greater than the exterior diameter of muzzle 5. In that the purpose of the jacket is to serve as a guide and holder for the muzzle, it is unnecessary that the jacket define a complete sidewall enclosure. Slots in the sidewall of the jacket may be provided for a ramrod, ramrod underlug, or sight member, as required.

For receiving muzzles of varying outside diameters and shapes, some muzzles being round and other octagonal, or of other configuration, the jacket is provided with a plurality of threaded, laterally disposed, apertures 42, operable to receive set screws 43 therein. In this manner, any muzzle 5, having a bore 6 of equal diameter to that of the cartridge, may be inserted into the jacket and held precisely in alignment so that the bore 56 of cartridge 50; bore 36 of second end portion 35; and bore 6 of muzzle 5 of the firearm are co-extensive. In the alternative, the jacket may be formed to confine precisely to the outside diameter of a specific muzzle.

For loading the contents of cartridge 50 into the muzzle, plunger rod 16 includes bullet starting button 17 mounted on its distal end. Button 17 is of only slightly less diameter than the bores of the cartridge, housing, and muzzle, through which it must pass. The button is constructed of brass, aluminum, rigid plastic, or other material so as to eliminate the chance of frictional spark. The opposing end of rod 16 may include a handle 18 for convenient reciprocation of the plunger.

Figure 4:
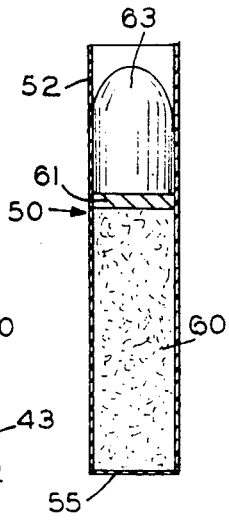
FIG. 4 is a side view in cross section of one embodiment of the cartridge, shown with contents.
Figure 7:
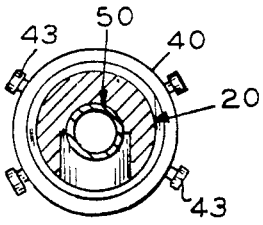
FIG. 7 is a section view taken along line 7—7 of FIG. 1.
Figure 6:
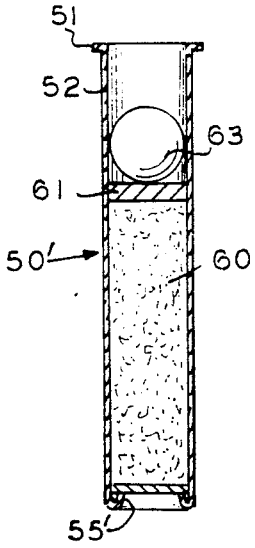
FIG. 6 is a side view of a second embodiment of the cartridge, shown with contents and crimping.
Figure 5:
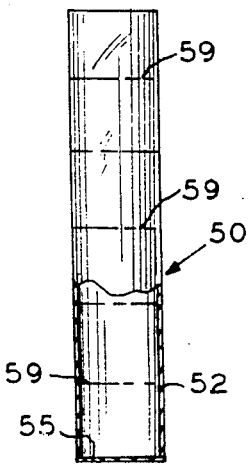
FIG. 5 is a side view of the cartridge of FIG. 4 showing capacity indicia.

Referring now to FIGS. 4–6, taken in conjunction with FIGS. 1 and 2, cartridge 50 may be seen to advantage. For standardizing, cartridges 50 all have the same external dimensions. The size of the bore 56 of the cartridge must match the size of the bore of the muzzle and, for this reason, the thickness of the sidewall 52 will vary. In one embodiment, shown in FIGS. 4 and 5, the cartridge is constructed of translucent and preferably rigid transparent thermoset plastic. For determining the amount of black powder charge received with the cartridge, the cartridge may be scored, or otherwise marked, with suitable indicia 59. For retention of the charge within the cartridge, a thin layer of frangible membrane, such as flash paper 55, cellophane, scored paper or plastic, or the like is affixed, by any suitable adhesive, to cover the bottom of the cartridge. Flash paper, which is thin, readily ignitable, and which leaves a minimum of residue, is very desirable in that it may be torn and inserted into the bore of the muzzle without damage to or interference in the use of the firearm.

Once the flash paper is affixed in place over the bottom of the cartridge, a selected amount of black powder 60 is poured into the cartridge; a wad or patch 61 added, if desired; and a projectile 63, in the form of a ball or bullet, inserted at the top end of the cartridge. The projectile frictionally engages the interior sidewalls of bore 56 of the cartridge, holding, in cooperation with the flash paper, all contents of the cartridge in place.

Referring to FIG. 6, a second embodiment of a cartridge 50' is shown. Cartridge 50' may be constructed of paper, plastic, or other material as in conventional shot gun shells, and, like such shells, includes a crimped end portion 55' for holding a charge in place. A projectile, ball 63, closes the opposing end of the cartridge. Cartridge 50' may be provided with a lip 51, operable to engage a shoulder, not shown, formed in first end portion 25 of the cartridge housing, so that the crimped end may properly unfurl upon depression of the plunger.

For loading the muzzle, a pre-filled cartridge, such as shown in FIG. 4, is inserted into slot 31 of cartridge housing 20, with plunger 15, as shown in FIG. 1, in the retracted position. The cartridge is installed with the flash paper adjacent second end 35 of the housing and projectile 63 adjacent first end 25 of the housing. Housing 20 is then fitted over the end of muzzle 5 of the firearm with the muzzle inserted into jacket 40 and the end of the muzzle abutting end portion 35 of the housing. Where set screws 43 are present, the screws may be pre-set to coincide with the outer sidewall of the muzzle. Plunger 15 is then depressed, with button 17 of the plunger engaging the top of the projectile 63, to force all contents of the cartridge through bore 36 of the second end portion 35 and into bore 6 of the muzzle 5 of the firearm; the plunger being in the position shown in FIG. 2. It will be appreciated that all contents are injected into the muzzle with one stroke of the plunger. Plunger 15 is then retracted to the position shown in FIG. 1. The empty cartridge may then be ejected from the housing by pushing it by a finger inserted through aperture 38 of the housing. A ramrod, not shown, is then used to push the charge into the firing position within the muzzle, as is conventional.

Having thus described in detail a preferred selection of embodiments of the present invention, it is to be appreciated and will be apparent to those skilled in the art that many physical changes could be made in the apparatus without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

I claim:

1. A muzzle loading device for muzzle loading firearms, comprising:

an elongated tubular cartridge defining a bore and provided at one end thereof with powder charge retention means;

a cartridge housing having a mid portion; a first end portion; and a second end portion; said mid portion provided with an elongated slot with side opening operable to laterally receive and hold said cartridge, and each of said end portions provided with an aperture, coaxial with the aperture of an opposing end portion and with the bore of said cartridge when received in said slot; and a plunger reciprocally receivable within the apertures of said end portions and within the bore of said cartridge for pushing the contents of said cartridge into the muzzle of a firearm.

2. The device as described in claim 1 wherein said second end portion of said housing is provided with muzzle receiving means.

3. The device as described in claim 2 wherein said muzzle receiving means includes a tubular jacket including a bore having an inside diameter slightly in excess of the outside diameter of the muzzle of the firearm for holding the bore of the muzzle in alignment with the bore of said cartridge.

4. The device as described in claim 3 wherein said jacket is provided with a plurality of threaded apertures, laterally extending therethrough and a plurality of screw members, each of said screw members operable to threadably engage a respective aperture to abut the outer surface of the muzzle for precise positioning of the bore of said muzzle relative to the bore of said cartridge.

5. The device as described in claim 1 wherein said mid portion of said housing is provided with a laterally disposed opening for manual removal of said cartridge from said cartridge receiving slot.

6. The device as described in claim 1 wherein said cartridge is constructed of transparent material.

7. The device as described in claim 6 wherein said cartridge is provided with indicia for determining the volumetric contents of said cartridge.

8. The device as described in claim 1 wherein said cartridge includes a bore having an inside diameter equal to the inside diameter of the bore of the muzzle of the firearm.

9. The device as described in claim 1 wherein said powder charge retention means comprises a frangible membrane.

10. The device as described in claim 9 wherein said membrane comprises flash paper.

11. The device as described in claim 1 wherein said powder charge retention means comprises a resilient crimp member.

* * * * *